United States Patent [19]

Kolibas

[11] Patent Number: 4,465,922

[45] Date of Patent: Aug. 14, 1984

[54] ELECTRIC HEATER FOR HEATING HIGH SOLIDS FLUID COATING MATERIALS

[75] Inventor: James A. Kolibas, Broadview Hts., Ohio

[73] Assignee: Nordson Corporation, Amherst, Ohio

[21] Appl. No.: 410,009

[22] Filed: Aug. 20, 1982

[51] Int. Cl.[3] ..... H05B 1/02; F24H 1/12; B05B 1/24; B05B 7/16

[52] U.S. Cl. ..... 219/304; 165/156; 219/299; 219/302; 219/305; 222/146 HE; 239/135

[58] Field of Search ..... 219/296–299, 219/301–305, 308, 309, 271, 275; 239/133–136; 165/141, 156; 123/549, 557; 222/146 HE, 146 H, 146 R

[56] References Cited

U.S. PATENT DOCUMENTS

| | | | |
|---|---|---|---|
| 1,138,593 | 5/1915 | Mosteller | 219/297 |
| 1,298,301 | 3/1919 | David | 219/299 |
| 1,474,104 | 11/1923 | Burgess | 219/298 X |
| 3,584,194 | 6/1971 | Kautz et al. | 165/156 X |
| 3,782,456 | 1/1974 | Gusmer | 219/302 X |
| 3,835,294 | 9/1974 | Krohn et al. | 219/302 X |
| 4,199,675 | 4/1980 | Sharpless | 219/302 X |
| 4,259,937 | 4/1981 | Elliott | 123/549 X |

FOREIGN PATENT DOCUMENTS

| | | | |
|---|---|---|---|
| 2156029 | 5/1973 | Fed. Rep. of Germany | 219/305 |
| 809123 | 12/1936 | France | 165/156 |
| 110883 | 8/1980 | Japan | 165/156 |

*Primary Examiner*—A. Bartis

*Attorney, Agent, or Firm*—Michael L. Gill; Edmund J. Wasp; John P. Donohue, Jr.

[57] ABSTRACT

A fluid heater for heating high solids fluids having a solids content approximately 50% or higher, which fluids are applied to a substrate by a coating process, includes a cylindrical body of thermally conductive material having a helical channel formed on the outer periphery thereof and including a section member dividing the channel into a pair of side-by-side passages, each having a cross-sectional area of about 0.119 square inches and a length of about 80 inches. A common input plenum identical in size to the cross-sectional area of the channel communicates with one end of each of the passages and the other end of the passages are connected to a common output plenum. An electric heating element is located in said body along the central axis thereof and is sized to produce a watt density on the surface of said passages in the range of 7.5 to 8.0 watts per square inch whereby the high solids fluids are heated for ease in application with a minimum loss of fluid pressure upon passing through the heater.

10 Claims, 1 Drawing Figure

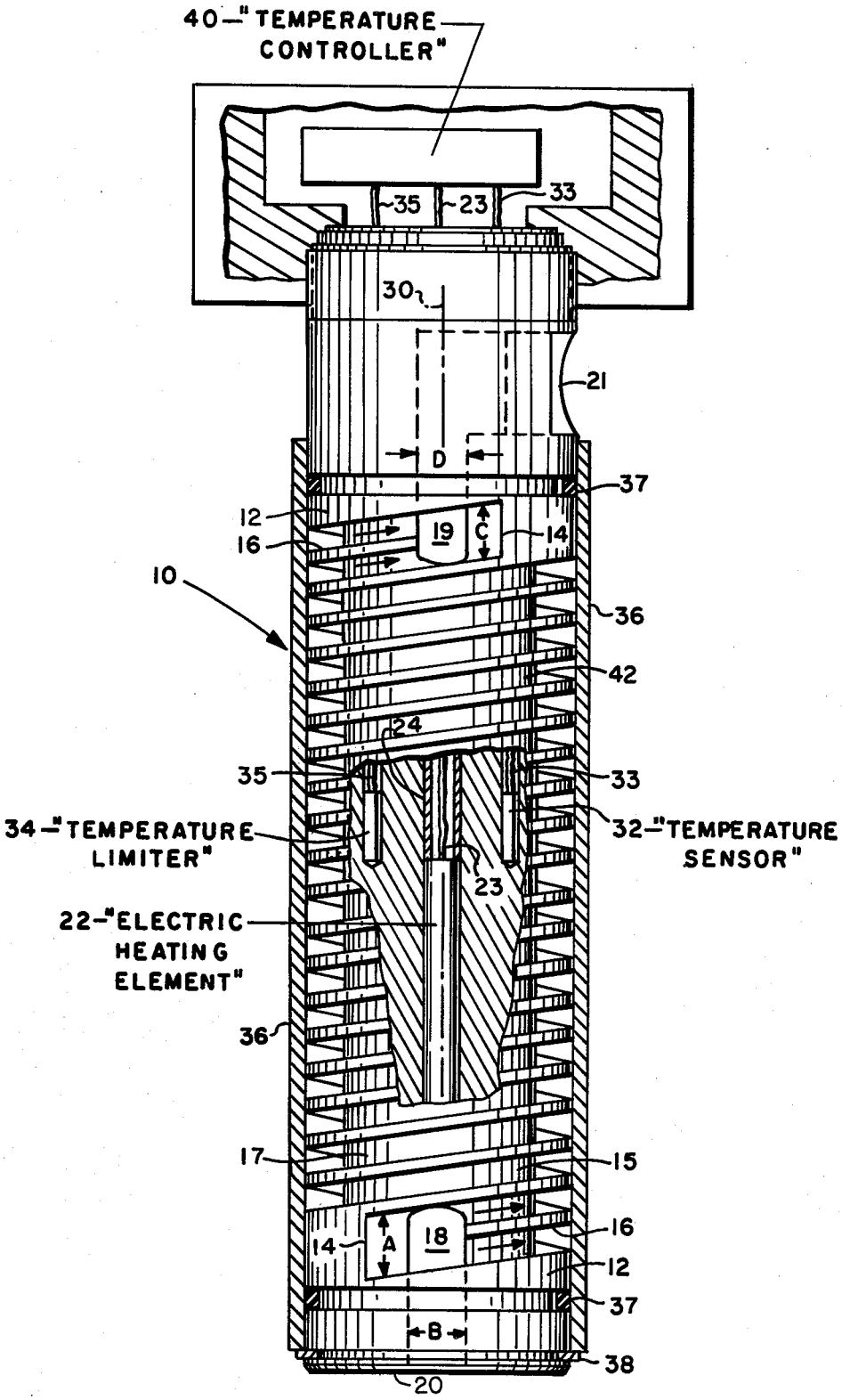
40—"TEMPERATURE CONTROLLER"
35
23
33
30
21
D
37
12
16
19
C
14
10
36
42
24
35
33
34—"TEMPERATURE LIMITER"
32—"TEMPERATURE SENSOR"
23
22—"ELECTRIC HEATING ELEMENT"
36
17
15
16
14
A
18
12
37
B
38
20

ELECTRIC HEATER FOR HEATING HIGH SOLIDS FLUID COATING MATERIALS

BACKGROUND OF THE INVENTION

1. Field of the Invention

This invention relates to fluid heaters and more particularly to fluid heaters used in connection with high solids materials used in coating applications.

2. Description of Prior Heaters

Fluid heaters for heating coating material prior to application are known. U.S. Pat. No. 3,835,294-Krohn et al. and U.S. Pat. No. 4,199,679-Sharpless describe typical fluid heaters which are cylindrical and have a single spiral passageway through which coating material flows from an inlet at the bottom to an outlet at the top. Heat is transferred from a core or source to the fluid through the passageway sidewalls. Another form of single passageway heater is that shown in German Offenlegungsschrift No. 2156029 published on May 17, 1973. The heater has a series of parallel annular channels formed in a core about a central axis. Fluid to be heated flows from annular channel to annular channel by a port formed in each. Each adjacent port is disposed 180° from the previous port.

In use, the known heaters are not suitable for heat-highly viscous materials such as high solids coating materials which are typically over 50% solids material by weight or by volume in solution/suspension. The high solids coating materials suffer a notable pressure drop when passing through heaters of the type described above, and are not heated quickly, thoroughly or evenly. Increased pumping capacity may be required to attain only acceptable results at a notable increase in cost. Use of a wide passage heater such as the NH-4 wide passage heater manufactured by Nordson Corporation of Amherst, Ohio provides for reduced pressure drop but does not heat the highly viscous material uniformly and provide for sufficient heat transfer.

A heater which heats highly viscous materials such as high solids coating materials with less pressure drop while thoroughly and evenly heating the material is not known.

SUMMARY OF THE INVENTION

The instant invention has a thermally conductive body in heat transfer relationship with a heating element. A channel is formed in this body for passing the high solids material therethrough and transferring heat thereto. This channel is further divided into a plurality of passages having substantially identical cross-sectional area. The channel is also provided with an input plenum and an output plenum, which are formed to supply and receive material respectively from the channel. In a preferred embodiment, the channel is spiralled about the heater body. In a highly preferred embodiment the body is cylindrical with the channel formed in the surface thereof and with a cover in fluid tight engagement around the body.

BRIEF DESCRIPTION OF THE DRAWING

In the drawing which illustrates the best mode presently contemplated for carrying out the invention, the sole FIGURE depicts a partial cross-section and cutaway view of an embodiment of the instant invention.

DESCRIPTION OF THE ILLUSTRATED EMBODIMENT

The heater shown in the drawing has a heating element and a thermally conductive body assembled in a fashion similar to that described and illustrated in U.S. Pat. No. 4,199,675 the contents of which are incorporated herein by reference thereto. As shown in the drawing, the heater of the instant invention necessarily includes a central bore cavity, an electric heating element 22 disposed within said bore cavity, a tube 24 for maintaining the heating element within the bore, a series of other bores for containing a temperature sensor 32 and temperature limiter 34, and control means 40 for receiving the sensed temperature and limiting temperature signals and controlling the heating element in response thereto. The illustrated heater will also necessarily include a cover 36 which is held in fluid tight engagement, such that high solids material will be contained within the channel 14. In the preferred embodiment, the cover 36 is also made from a thermally conductive material.

Referring specifically to the drawing a heater according to the instant invention is generally designated as 10. The heater 10 has a thermally conductive body 12 in which the channel 14 is formed. Section member 16 is provided in channel 14 for dividing the channel into a plurality of passages. Two passages 15 and 17 are adequate in most instances. Thus, material entering the inlet opening 20 (shown in dotted lines in the drawing) travels through input plenum 18 into channel 14 and in turn passages 15 and 17. After the material has traveled the length of passages 15, 7, it exits into output plenum 19 and passes therethrough to outlet opening 21. Standard couplings can be made to inlet opening 20 and outlet opening 21 and is more clearly described in U.S. Pat. No. 4,199,675.

As earlier described, the electrical heating element 22 is positioned centrally in the thermally conductive body 12 in a bore formed therein in any conventional manner. Element 22 is held in place by a tube 24 and interconnected with controller 40 via conductors 23.

Section member 16 divides channel 14 into passages of substantially identical cross-sectional area. Section member 16 is of a thermally conductive material, and is in thermal contact with the body 12 to receive and transfer heat to the material passing therethrough. Section member 16 is sized, positioned, made of a thermally conductive material and formed to have a thermal mass to effect substantially uniform heating to the material flowing in each passage 15, 17. The section member 16 is shown as extending from the bottom surface 42 of channel 14 toward cover 36. However, member 16 need not be in direct contact with cover 36. The provision of section member 16 according to the instant invention, assures substantially uniform heating of the material, even when high solids content material, such as paint having a solids content greater than forty percent, is used.

As is also shown in the drawing, the input and output plenums 18 and 19 are in direct fluid flow relationship with passages 15 and 17 and the cross-sectional area of the input plenum is substantially identical to the cross-sectional area of the channel. With regard to input plenum 18, the cross-sectional area A of channel 14 is identical to the cross-sectional area B of input plenum 18. Likewise, the cross-sectional area of channel 14 adjacent the output plenum C is identical to the cross-sectional area of output plenum 19 D. The cross-sectional areas designated as A and C of channel 14 are preferably equal.

High solids material preferably enters through input plenum 18 at the bottom of the heater and flows upwardly in the direction of the arrows shown in the drawing. As previously described, section member 16 is of such a size, position and thermal mass that the high solids material passing to both sides is substantially evenly heated, that is, it receives heat from member 16 the walls of channel 14 to effect substantially a uniform heating of the material. In the preferred embodiment, section member 16 is integrally formed with the body 12.

It has been discovered that an analysis of a cross-section of flowing high solids material has a viscosity gradient associated therewith, such that the material in the center of the cross-section moves at a higher velocity than the outer limits of the area. The passages formed in channel 14 are sized such that the velocity gradient does not serve to cause non-uniform heating. In other words, high solids material passing therethrough is heated to a substantially uniform pre-selected temperature. In the preferred embodiment, the cross-sectional heating area of the passages in a single section of channel 14 including section member 16 totals approximately 0.238 square inches (0.119 square inches per passage) and the overall length of each passage 15, 17 is about 80 inches. It has been found that such a sizing will assure substantially uniform heating of material even when the solids content of the material reaches 80 percent or higher. The preferred embodiment will also have a watt density on the surface area of channel 14 in contact with the material flowing therethrough, in the range of 7.5 to 8.0 watts per square inch.

Thermally conductive body 12 is generally cylindrical in shape about a central axis 30. Electric heating element 22 is concentrically positioned with respect to axis 30. Channel 14 is generally of a helical configuration about axis 30. Substantially uniform spacing of helical channel 14 about axis 30 assures that substantially uniform heat transfer will occur.

Controller 40 is provided to maintain the heat generated by heating element 22 at a substantially constant preselected temperature. Controller 40 is generally well known in the art and is more completely described in U.S. Pat. No. 4,199,675. A sensor 32 and temperature limiter 34 are also provided in the thermally conductive body 12 in a position proximate channel 14. Sensor 32 and limiter 34 are connected to controller 40 via wires 33 and 35 respectively. Sensor 32 generates a signal which is reflective of the temperature proximate channel 14 and transmits same to controller 40. Controller 40, in turn, energizes and de-energizes heating element 22 in response to the signal received from sensor 32.

As can be seen in the drawing, channel 14 is formed on the surface of thermally conductive body 12. To establish a fluid passage, cover 36 is held in fluid tight engagement therewith. A fluid tight seal is maintained above and below channel 14 by 'o' ring seals 37. In the preferred embodiment, cover 36 is also maintained in its position by a 'c'-clip 38, such clips being well known in the art. It is preferred that cover 36 be made from thermally conductive material, such that heat transferred from body 12 and section member 16 to cover 36 can be re-transferred to the material passing through channel 14.

Empirically it has been noted that high solids material passing through the heater of the instant invention is substantially and more uniformly heated with less pressure drop than heaters heretofore known. It is common to cascade known heaters to achieve a desired rise in temperature of the material being heated. As can be appreciated, the pressure drop associated with each heater is additive when a plurality of heaters are combined in series. By dividing channel 14 into two passages, the pressure drop which would have developed in a single elongated passage heater has been reduced while at the same time allowing for greater heat transfer and in turn more uniform temperature of the material as it exits the heater of the instant invention.

A heater of the type herein described is particularly useful in hot industrial spray and coating systems. In such systems, material is pumped from a source through a heater to a spray gun which atomizes the material for coating a substrate. Use of the instant invention when flow rates are very high (e.g. 3–7 gallons per minute) or when the material is highly viscous or a high solids material minimizes pressure drop in the fluid system while providing for even and thorough heating. Flow rates, temperature and pressure into the spray gun for the highly viscous and high solids materials can therefore be obtained to assure proper performance of the spray gun and in turn acceptable industrial finishes and coatings.

Although the instant invention has been described in terms of a preferred embodiment, those skilled in the art will recognize that other forms may be adopted within the scope of the following appended claims.

I claim:

1. A heater for high solids fluids having a solids content of approximately 50 percent or greater by weight or volume, which fluids are applied to a substrate by a coating system, comprising:

a. a body made of thermally conductive material;

b. a channel formed on the outer periphery of said body including section means for defining a pair of side-by-side passages, each of said passages having an identical cross-sectional area of about 0.119 square inches and a length of about 80 inches;

c. a common input plenum at one end of said channel in fluid communication with each of said passages;

d. a common output plenum at the other end of said channel in fluid communication with each of said passages; and e. heating means for generating heat, positioned to supply heat to said thermally conductive body, said heating means sized to produce a watt density on the surface of said passages in the range of 7.5 to 8.0 watts per square inch, whereby high solids fluids are heated for ease in application by said coating system with a minimum loss of fluid pressure upon passing through said heater.

2. The heater of claim 1, wherein said section means is thermally conductive and in thermal contact with said body to receive heat therefrom and to transfer heat to said material.

3. The heater of claim 2, wherein said section means has a thermal mass so that said material is substantially evenly heated as it passes through each of said passages.

4. The heater of claim 3, wherein said section means is integrally formed with said body.

5. The heater of claim 1, wherein said input and output plenums are in direct fluid flow relationship with said passages and wherein the cross-sectional area of said input plenum is substantially identical to the cross-sectional area of said channel.

6. The heater of claim 1, wherein said body surrounds said heating means and said channel is of a generally helical configuration about a central axis.

7. The heater of claim 6, wherein said heating means is comprised of a heating element disposed along said central axis and control means connected to said heating element to energize and deenergize same.

8. The heater of claim 7, further comprising a sensor disposed in said body, proximate said channel, which generates a signal reflective of the temperature proximate said channel and which is connected to said control means, such that said control means energizes said heating element in response to said temperature signal.

9. The heater of claim 6, wherein said channel is formed on the surface of said body and further comprising a cover member in fluid tight engagement with that portion of said body wherein said channel is formed.

10. The heater of claim 9, wherein said cover member is thermally conductive so that heat is transfered to said material therefrom.

* * * * *